US008371445B2

(12) United States Patent
Seabaugh et al.

(10) Patent No.: US 8,371,445 B2
(45) Date of Patent: Feb. 12, 2013

(54) COMPRESSIBLE TISSUE CARTON

(75) Inventors: Michelle Lynn Seabaugh, Appleton, WI (US); Bart John Rabas, Appleton, WI (US); John Fitzgerald Janz, Greenville, WI (US); Kyle John Schuman, Appleton, WI (US); Leslie Thomas Long, Appleton, WI (US); Peter Booth, Marlborough (GB); Alan David Whiting, Marlborough (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 45 days.

(21) Appl. No.: 12/951,207

(22) Filed: Nov. 22, 2010

(65) Prior Publication Data

US 2012/0125988 A1 May 24, 2012

(51) Int. Cl.
*B65D 73/00* (2006.01)
*B65H 1/00* (2006.01)
*B65D 5/56* (2006.01)

(52) U.S. Cl. ..... 206/494; 206/233; 221/64; 221/65; 229/101; 229/117.06

(58) Field of Classification Search ..... 206/37, 206/38, 233, 494; 229/87.03, 101, 117.06; 221/45, 46, 64, 65
See application file for complete search history.

(56) References Cited

U.S. PATENT DOCUMENTS

| | | | | |
|---|---|---|---|---|
| 2,574,345 | A * | 11/1951 | Montgomery | 206/233 |
| 2,579,758 | A * | 12/1951 | Rosenman et al. | 206/37 |
| 2,656,916 | A | 10/1953 | Henderson | |
| 2,826,230 | A * | 3/1958 | Conell | 206/37 |
| 3,144,979 | A * | 8/1964 | Young | 229/101 |
| 3,197,062 | A | 7/1965 | Day et al. | |
| 3,260,172 | A * | 7/1966 | Young | 493/59 |
| 4,678,882 | A * | 7/1987 | Bohrer et al. | 229/101 |
| 4,760,951 | A | 8/1988 | MacGregor | |
| 5,016,753 | A | 5/1991 | Henderson | |
| 5,507,130 | A | 4/1996 | Young et al. | |
| 5,516,000 | A | 5/1996 | Freiburger et al. | |
| 5,540,354 | A | 7/1996 | Annand | |
| D376,501 | S | 12/1996 | Spaseska | |
| D378,330 | S | 3/1997 | Spaseska | |
| 5,666,786 | A | 9/1997 | Focke et al. | |
| 5,857,311 | A | 1/1999 | Focke et al. | |
| 6,015,045 | A | 1/2000 | Joseph et al. | |
| 6,102,277 | A | 8/2000 | Krapohl, Sr. | |

(Continued)

FOREIGN PATENT DOCUMENTS

| | | |
|---|---|---|
| DE | 202 00 700 U1 | 8/2007 |
| FR | 2 914 281 A1 | 10/2008 |

(Continued)

*Primary Examiner* — Bryon Gehman
(74) *Attorney, Agent, or Firm* — Michael J. Sullivan

(57) ABSTRACT

A compressible package having pair of scored sidewalls, which facilitate compression of the package into a wedge shape for storage in narrow recesses. Optionally, the compressible package may include a scored bottom flap wherein the bottom portion of the sidewalls and the bottom flap are shaped such that when the carton is compressed by a user the resulting shape of the bottom flap complements the shape of the sidewalls, maintaining a substantially closed carton. Preferably the compressible package is a carton for storing and dispensing tissue and the carton assumes a wedge shape, which allows the carton to be fit into tight spaces, such as between the seat and the center console of the automobile while maintaining a substantially closed carton.

20 Claims, 5 Drawing Sheets

U.S. PATENT DOCUMENTS

| | | | | |
|---|---|---|---|---|
| 6,409,044 | B1 | 6/2002 | Brown et al. | |
| 6,863,192 | B2 | 3/2005 | Tumlinson | |
| 6,886,714 | B2 | 5/2005 | Kruchoski et al. | |
| 6,918,488 | B2 | 7/2005 | Renhed | |
| D559,098 | S | 1/2008 | Wilbur | |
| 7,377,391 | B2 * | 5/2008 | Long et al. | 206/494 |
| 7,571,832 | B2 | 8/2009 | Mark et al. | |
| 7,810,641 | B2 * | 10/2010 | Hungler et al. | 206/233 |
| 2005/0000976 | A1 | 1/2005 | Keberlein | |
| 2006/0055083 | A1 | 3/2006 | Kim et al. | |
| 2007/0262086 | A1 | 11/2007 | Cook et al. | |
| 2008/0257903 | A1 | 10/2008 | Hirasawa et al. | |
| 2010/0078444 | A1 | 4/2010 | Shannon et al. | |

FOREIGN PATENT DOCUMENTS

| | | | |
|---|---|---|---|
| JP | 05-032279 | A | 2/1993 |
| JP | 07-315458 | A | 12/1995 |
| JP | 09-140623 | A | 6/1997 |
| JP | 09-140624 | A | 6/1997 |
| JP | 2000-168860 | A | 6/2000 |
| JP | 2002-179164 | A | 6/2002 |
| JP | 2004-026294 | A | 1/2004 |
| JP | 2010-047270 | A | 3/2010 |
| KR | 1020050080130 | | 5/2005 |
| KR | 2008-0009791 | A | 1/2008 |

* cited by examiner

COMPRESSIBLE TISSUE CARTON

TECHNICAL FIELD

This application relates generally to a compressible package having a pair of scored sidewalls, which facilitate compression of the package into a wedge shape for storage in narrow recesses.

BACKGROUND

Increasingly, producers of consumer product dispensers, such as facial tissue cartons, are interested in alternative shapes besides the typical parallelepiped shapes generally offered. A parallelepiped (rectangular prism) can offer several advantages such as efficient packing of the product, efficient distribution of the product, and efficient board utilization to make the carton. However, consumers have grown accustomed to such shapes and there is little differentiation from one product to another. Graphical treatments can help, but the basic dispenser shapes are still largely the same for all manufacturers.

While well adapted to the storage and dispersal of tissue, such shaped dispensers are typically not sized or shaped for efficient use outside of the home. Alternative shaped dispensers have been proposed, however, they do not satisfy all of the consumer's out of home tissue dispensing needs and often consist of shapes and sizes that significantly increase product distribution costs, which are passed on to customers, making potential alternative dispenser shapes more expensive for retailers and consumers alike and therefore potentially less desirable.

One particular out-of-home location where traditional dispensers are inefficient is the automobile. Traditional dispensers do not fit into convenient locations within the driver's reach, such as map pockets, dash pockets or console compartments. Consequently tissue packages are usually placed on the front or back seat, the floor, the rear window shelf or glove compartments which may be hard to reach. Placement in these locations also means the packages often get stepped on, sat upon or smashed when something is accidentally placed on top of them, often resulting in damage to the dispensing feature of the carton where the opening is torn or bent, thus causing the tissues to tear while dispensing. Another problem is that the packages move around and can't be found. They slide along the seat, the floor, or under the seat. Packages may become located under the driver's feet or near the car foot pedals, which may create a safety hazard. The fact that the facial tissue packages are often not held securely in place and are difficult to find can also be hazardous if the driver becomes distracted in searching for the tissue package and is unable to use both hands for driving.

Therefore, a need exists for dispenser shapes that are significantly differentiated from the typical parallelepiped shape, yet, at the same time, can be readily used out of home and particularly in automobiles. Accordingly, the present invention provides a collapsible carton that overcomes the limitations of prior art tissue containers.

SUMMARY

It has been discovered that properly designed facial tissue packages solve the current problems with existing facial tissue packages used in vehicles, thus satisfying unmet consumer needs. In general, the compressible carton is designed to fit into small compartment locations convenient for the driver's use while containing the maximum number of tissues for its size. The compressible carton is not only slim, allowing the carton to fit into the map pockets, dash pockets and console compartments of the majority of vehicles, but compressible wedge shape also allows it to fit in a variety of spaces within a vehicle, such as the space between a seat and the console. This makes the cartons easy to locate, prevents them from being moved around, and protects them from being damaged. The tissue dispensing slit is located such that the tissue is facing the consumer when the carton is stored in the vehicle rather than being covered up as in existing facial tissue cartons.

Hence in one aspect, the invention resides collapsible carton comprising a front and back panel; a pair of opposing sidewalls, each sidewall having a score mark disposed substantially vertically approximately along its midpoint, wherein the score marks permit a user to compress the carton; at least one top flap folded to form a carton top; a bottom flap extending from the front or back panel and folded to form a carton bottom, the bottom flap having a score mark disposed substantially horizontally approximately along its midpoint, wherein the score mark permits a user to compress the carton; and a carton opening.

To improve the ability to wedge the carton into tight spaces, such as between the seat and the center console of the automobile while maintaining a substantially closed carton, in a preferred embodiment, the sidewall shapes for the carton are irregular pentagon shaped having a pair of substantially parallel sides and a triangular-shaped bottom portion. In a particularly preferred embodiment the triangular-shaped bottom portion is an isosceles triangle having an angle $\alpha$ from about 100 to about 150 degrees.

In still other aspects the invention resides in a carton blank for forming a collapsible carton, the blank comprising a first, second and third rectangular face, a pair of sidewalls separated from each other by the rectangular faces, each sidewall having a score mark disposed substantially vertically approximately along its midpoint, a plurality of top flaps comprising two minor top flaps extending from the sidewalls, and a major top flap extending from at least one of the rectangular faces, a bottom flap extending from at least one of the rectangular faces, the bottom flap having at least one substantially horizontal score mark and a carton opening. In a preferred embodiment the sidewalls are irregular pentagon shaped having a triangular-shaped bottom portion that is bisected by the score mark disposed longitudinally along the midpoint of the sidewall.

In still other aspects the invention resides in a compressible carton comprising a rectangular front wall, a rectangular rear wall, a pair of triangular- or trapezoid-shaped sidewalls connecting the front and rear walls, the sidewalls each having a score mark disposed longitudinally along their midpoint, wherein the score marks permit a user to compress the carton, a rectangular bottom wall, the bottom wall having a score mark disposed horizontally approximately along its midpoint, wherein the score marks permit a user to compress the carton; and a carton opening.

DETAILED DESCRIPTION

While the compressible container disclosed herein is generally described as being a carton for storing and dispensing tissue, one skilled in the art will understand that the carton may be used to store and dispense other types of folded sheet products. Thus, the term "tissue" is not intended to be limited to facial tissues, but is used herein to include any individual sheet product, such as dry or moistened wipes, for example household or industrial wipes, soap or fabric softening sheets, or the like.

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "compressible" refers to the ability of the carton of the present invention to yield under a force applied by a user, more specifically the term refers to the ability of a user to deform the carton in the z-direction by applying opposing force to the front and back panels of the carton.

As used herein, "score mark" refers to any line of weakness and includes score lines, creases, folds, perforations and the like formed by, for example, creasing, scoring, perforating, embossing or otherwise compressing, cutting and/or weakening the carton material.

Figure 1:
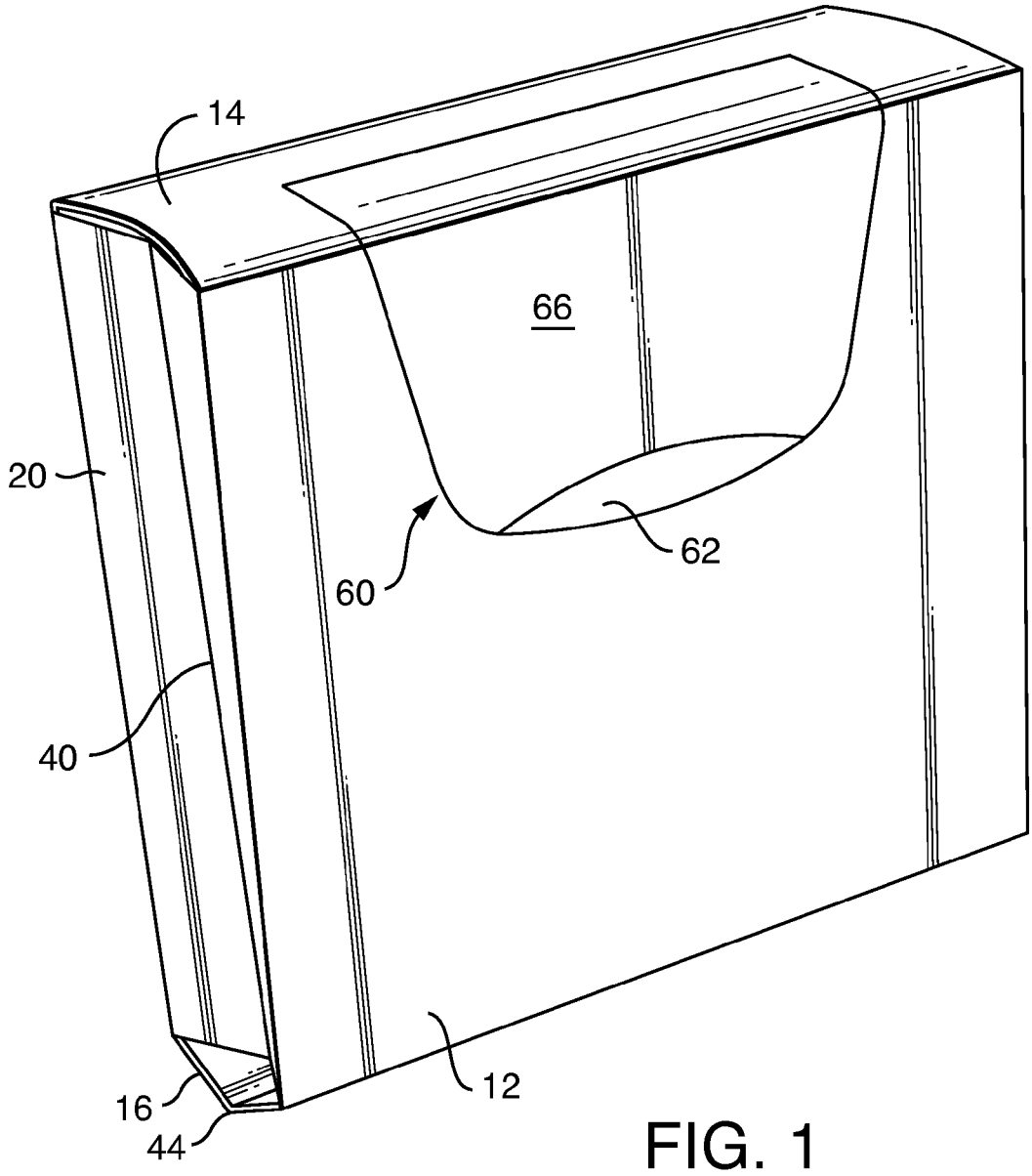
FIG. 1 illustrates a perspective view a container incorporating features of the present invention.

Turning now to FIG. 1, which is a perspective view of a compressible carton 10 comprising a rectangular front 12 and back panel (not shown) separated by a pair of sidewalls (single sidewall 20 shown). The carton can be made from suitable materials that include, without limitation, cardboard, carton stock, paper board, polypropylene, polyethylene, polystyrene, ABS plastic, and plastic, amongst other suitable alternatives. The carton 10 further includes a dispensing opening 60 and optionally includes a dispensing window 50 and a removable surfboard 66 covering the dispensing window 50.

The carton 10 is closed by a plurality of top flaps, including a major top flap 14, and a bottom flap 16. The sidewalls 20 have score marks 40 disposed substantially vertically approximately along their centerline. The score mark 40 may extend the length of the sidewall or may extend only a portion of the length. In one embodiment the score mark ends from about ¼ to about 1½ inches below the top edge of the sidewall and still more preferably about ½ to about 1 inch below the top edge. When a user compresses the carton 10 by apply opposing force to the front 12 and back panel, the score marks 40 permit the sidewalls 20 to deform thereby reducing the depth of the carton in the z-direction.

In one embodiment, to further facilitate compression of the carton by the user while maintaining a substantially closed carton, the bottom flap 16 includes at least one score mark disposed horizontally along the flap. Like the score mark disposed vertically along the sidewall, the score mark along the bottom flap allows the bottom flap to be deformed when a user applies opposing pressure to the back and front panels of the carton. The resulting deformation of the bottom flap facilitates compression of the carton as the height of the bottom flap is decreased by the pressure applied by the user.

In a particularly preferred embodiment the bottom portion of the sidewalls 20 and the bottom flap 16 are shaped such that when the carton is compressed by a user the resulting shape of the bottom flap compliments the shape of the sidewalls, maintaining a substantially closed carton. For example, in one embodiment the sidewalls are irregular pentagon shaped having a pair of substantially parallel sides and a distal end that is triangular-shaped. In a particularly preferred embodiment the score mark disposed substantially along the midpoint of the sidewall extends through the length of the sidewall bisecting the triangular-shaped bottom portion. To complement the triangular-shaped bottom portion of the sidewalls, the bottom flap includes a pair of score marks. When the carton is compressed by the user the bottom flap forms a v-shape, which receives the triangular-shaped distal end of the sidewalls. By shaping the distal end of the sidewalls to be complementary to the shape of the bottom flap the carton remains substantially closed when compressed.

The embodiment in which the bottom flap comprises a pair of score marks results in the additional benefit of forming a tab extending from the v-shaped portion which may be tucked under the back panel to further close the carton. In a preferred embodiment the tab is not secured to the back panel, but rather is allowed to float freely, such that it may be repositioned in response to pressure applied to the carton by a user.

Figure 2:
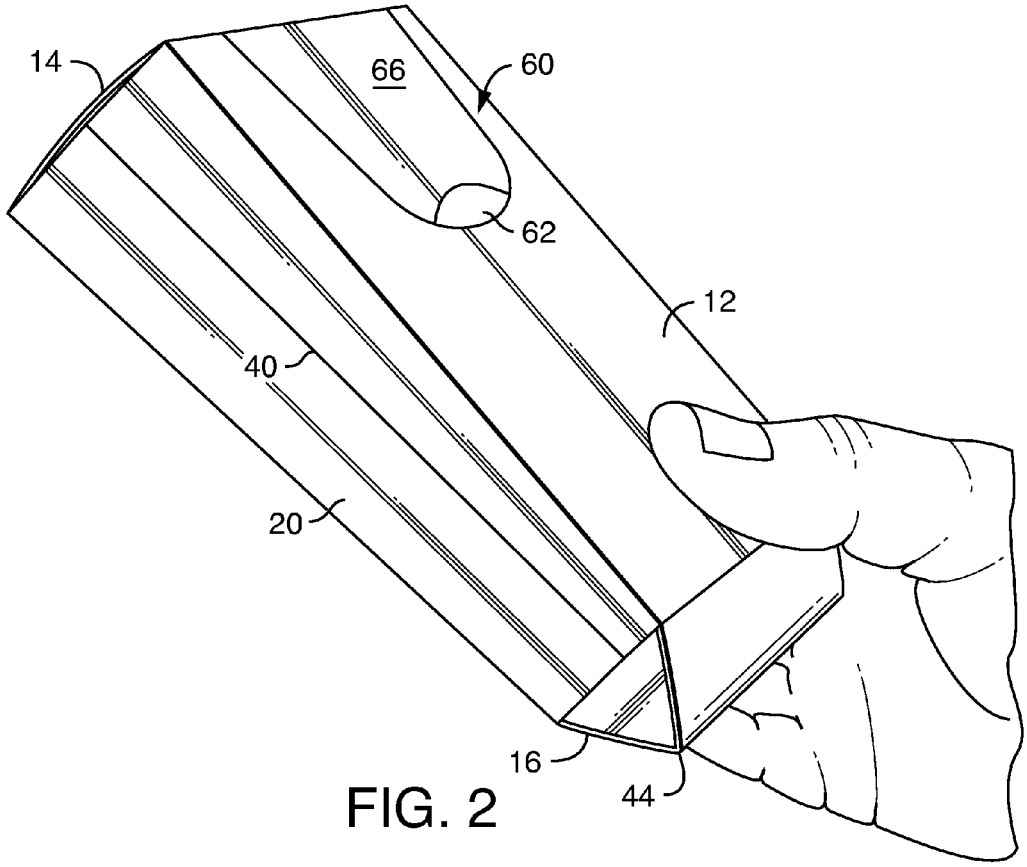
FIG. 2 illustrates the container of FIG. 1 in use.

Turning to FIG. 2, which illustrates compression of the carton of FIG. 1 by a user, deformation of the sidewalls and formation of the v-shaped bottom flap can be seen. In the illustrated embodiment the user compresses the carton by applying opposing force to the front 12 and back (not shown) panels. The carton 10 is compressed by deformation of the sidewalls 20 and the bottom flap 16. Deformation of the sidewalls 20 is facilitated by the vertical score mark 40 disposed substantially along the midpoint of the sidewall. When the user applies pressure the score mark 40 allows the sidewall 20 to collapse into the interior of the carton 10, reducing the dimension of the carton in the z-direction. The horizontal score mark 44 disposed substantially along the midpoint of the folded bottom flap also facilitates collapse of the carton by deforming under the force applied by the user. As further illustrated in FIG. 2, the force applied by the user causes the carton to compress resulting in a wedge shape that tapers from the top of the carton to the bottom.

Figure 3:
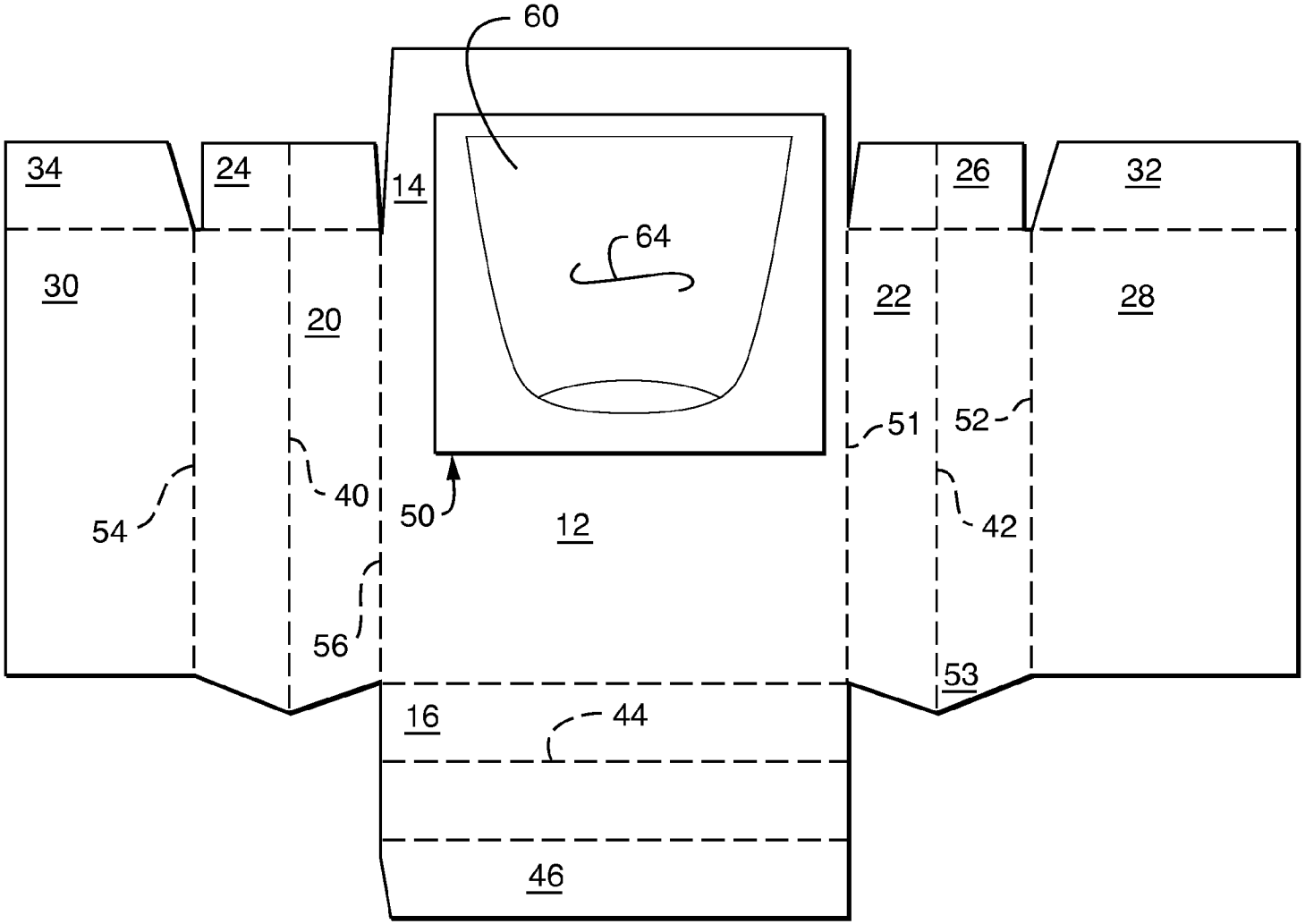
FIG. 3 illustrates a top view of a container blank in accordance with one embodiment of the invention.

Referring to FIG. 3, there is shown a plain top-view of the carton as a precut and preprinted blank prior to its folding to form the final carton shape. The blank, in the embodiment shown, comprises a first rectangular section 30, a first irregular pentagon section 22, a second rectangular section 12, a second irregular pentagon section 20, and a third rectangular section 28. Also in the embodiment shown, the carton blank comprises a plurality of top flaps 14, 24, 26, 32 and 34, and a bottom flap 16. The blank further comprises a plurality of creases, also referred to as score marks or fold lines, 51, 52, 54 and 56 that at least partially define the first, second and third rectangular sections 12, 28 and 30, as well as the first and second irregular pentagon sections 20, 22. The fold lines are generally formed by scoring, stamping, or otherwise forming the carton material with a line of weakness. Suitable additional fold lines are provided between the rectangular sections 12, 28 and 30, as well as the first and second irregular pentagon sections 20, 22 and the top and bottom flaps 14, 16, 24, 26, 32 and 34.

In the embodiment illustrated in FIG. 3, top flaps 14, 24, 26, 32 and 34 consist of four minor flaps 24, 26, 32 and 34, which extend from the first and third rectangular sections 22, 30 and the first and second irregular pentagon sections 20, 22 respectively and a major flap 14 extending from the second rectangular section 12. In one embodiment, when the blank is folded to form a carton, minor flaps 32, 34 overlap minor flaps 24, 26, which are in-turn overlapped by the major flap 14 to form the carton top.

Further in the embodiment illustrated in FIG. 3, the blank comprises first and second irregular pentagon sections 20, 22. When folded the first and second irregular pentagon sections 20, 22 form the sidewalls of the carton. Preferably the irregular pentagon sections 20, 22 have a pair of substantially parallel sides, which are defined by the score marks separating sections 20, 22 from rectangular sections 12, 28, 30. The bottom portion 53 of the pentagon sections 20, 22 is preferably triangle-shaped. Still more preferably the bottom portion 53 is an isosceles triangle having an angle α from about 100 to about 160 degrees and more preferably an angle α from about 120 to about 140 degrees. As further illustrated in FIG. 2, the triangle-shaped bottom portion 53 is bisected by a score mark 42, disposed substantially vertically down the midpoint of the irregular pentagon section 22. Without being bound by any particular theory, it is believed that when the blank is folded into a carton, the score marks disposed vertically along the sidewalls permit the carton to be compressed by a user. When a user compresses the carton 10 by apply opposing pressure to the front 12 and back 30 panels, the score marks 40, 42 permit the sidewalls 20, 22 to deform thereby reducing the width of the sidewalls and compressing the carton.

With further reference to FIG. 3, the bottom flap 16 extends from the second rectangular section 12. When folded, the bottom flap 16 forms the bottom of the container. The bottom flap 16 may be any suitable polygon shape such as rectangular, trapezoidal, a pentagon or a hexagon. The bottom flap 16 preferably includes at least one score mark disposed substantially horizontally along its midpoint and still more preferably a pair of substantially horizontally disposed score marks. In the preferred embodiment where two score marks are disposed substantially horizontally along the bottom flap 16, the score marks 44 and 46 divide the bottom flap 16 into first, second and third portions. When folded, the first and second portions of the bottom flap 16 form a v-shape that may receive the triangular-shaped bottom portion 53 of the sidewalls 20, 22 to form a substantially closed container when the container is compressed by a user. The third portion of the bottom flap is then folded upwards and fit behind the first 28 and second 30 back panel sections, which are folded together to form the back of the container. Preferably the bottom flap 16 is not affixed to either of the back panels, but rather, the flap is allowed to float freely and be repositioned in response to compression of the container by the user, thus maintaining a substantially closed carton.

To form a carton from the blank illustrated in FIG. 3, a first fold is made along fold line 54 and a second fold is made along fold line 56, forming the first sidewall 20 and the half of the back panel 30. A third fold is made along the fold line 51 and a fourth fold is made along fold line 52 to form the second sidewall 22, the front panel 12 and the second half of the back panel 28. The two halves of the back panel 28 and 30 are fastened together to form a continuous back panel by gluing or other method known in the art. The carton is completed by folding and securing the top flaps 14, 24, 26, 32 and 34 to form the top closure and by folding the bottom flap 16 along fold line separating the bottom flap 16 and the front panel 12. In a particularly preferred embodiment the bottom flap is folded into three parts including a tab 46, which is tucked behind the back panel to form the bottom of the carton. The bottom flap tab 46 may be secured to the back panel, however, it is preferred that the bottom flap be unsecured and allowed to float, facilitating compression of the carton by a user.

With further reference to FIG. 3, the carton blank further comprises dispensing opening 60 and optionally includes a dispensing window 50. For loading on an automated carton line, the dispensing widow should be pre-attached to the carton blank by attaching the dispensing window to either the inside or the outside of the top flap, preferably on the inside on as shown. The dispensing window can be made from suitable sheet materials such as a film, nonwoven, or paper material that can retain a partially dispensed sheet, such as a facial tissue, within the dispensing opening for pop-up dispensing. The dispensing window 50 has a dispensing orifice 64 that can be a slit; a curvilinear line; a geometric shape such as an oval, a circle, or a triangle; or an X shaped, + shaped or H shaped orifice. Alternatively, the dispensing window can be eliminated and fingers or tabs projecting into the dispensing opening 60 can be used to retain a partially dispensed sheet.

The dispensing opening 60 can be any size or shape such as square, circular, or oval. The dispensing opening 60 can be located such that it resides entirely in one of the top flaps or the dispensing opening 60 can be located such that a portion resides in the major top flap 14 and another portion resides in the front panel 12. By having the dispensing opening 60 span portions of the major top flap 14 and the front panel 12, the amount of board material utilized to form the carton can be minimized. This occurs since the overall size of the top flaps can be decreased because less material is needed to surround the dispensing opening. Additionally, by having the dispensing opening span portions of the container top and front panel, a unitary or one piece dispensing window can be used that simplifies the overall construction of the carton and allows for maximum flexibility in choosing the shape of the dispensing orifice. By unitary it is meant that the dispensing window is a single continuous piece rather than formed from two or more pieces that meet or overlap. Because the window is unitary, any desired shape for the dispensing orifice can be cut into the window without concern of having separate pieces meet or join together to form the dispensing orifice and/or dispensing window.

The carton further comprises an optional removable surfboard that can be attached to the top flaps by a perforated or weakened line. The removable surfboard can be used to prevent foreign materials from entering the assembled container and provides protection for the more fragile dispensing window during loading and shipping. The carton can also include an optional film wrapper that can span any of the front or rear panels, as well the top or bottom flaps. In a preferred embodiment the opposing ends of the film wrapper are attached to the top and bottom flaps of the chosen panel. By attaching the film wrapper 50 to a pair of opposing minor flaps, such as minor flaps 24 and 26 to span panel 12, the attached ends of the film wrapper can be hidden from view under the major top and bottom flaps after the container is assembled. The film wrapper can be perforated near both ends to permit easy removal. Additionally, other sheet materials beside film can be used to construct the wrapper. The film wrapper can be used to display printed information such as a prominent trademark that can identify the manufacturer at the point of purchase, which then later can be removed by the consumer so as not to detract from the graphic design on any one of the panels of the container.

When a plastic film with a dispensing slit is used to cover the carton opening to protect the tissues, there is preferably unsupported plastic film on either side of the slit. The dispensing slit is positioned along the top (front or back) edge of the carton. As used herein, "positioned along the edge" means that the slit is within about ¼ inch or less of the carton edge in order to allow the user to grasp the first tissue of the clip for dispensing. Once the first tissue is dispensed, the following tissues are pulled through the dispensing slit one at a time as a result of the interfolding, resulting in pop-up dispensing. Each successive tissue is held in place, partially exposed, by the dispensing slit.

Figure 4:
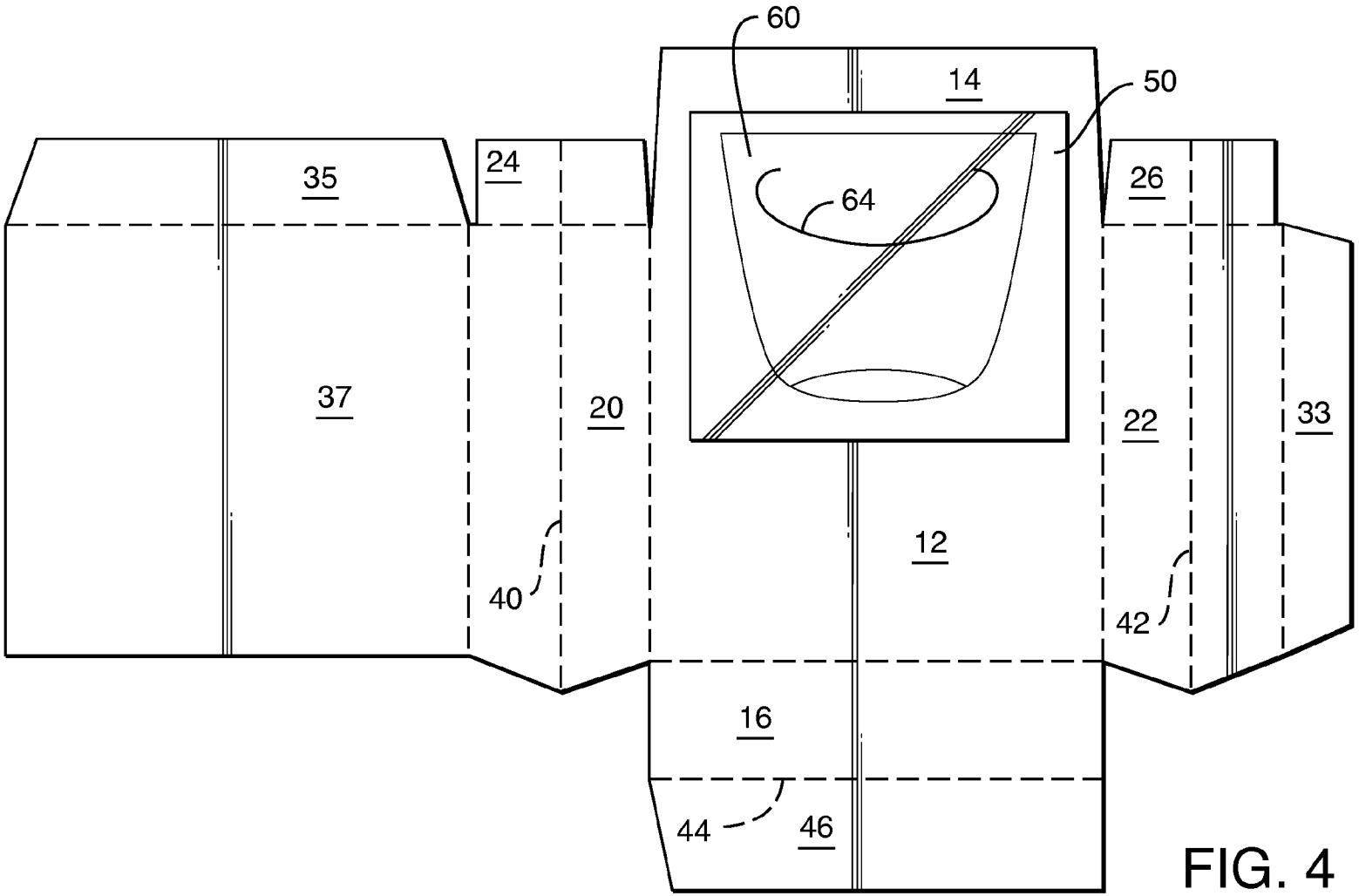
FIG. 4 illustrates a top view of a container blank in accordance with another embodiment of the invention.

Now referring to FIG. 4, an alternative embodiment of a blank for forming a compressible carton is illustrated. In the embodiment illustrated in FIG. 4, the back panel 37 of the carton is formed from a single piece of material and the carton is formed by joining the single piece of backing material to the sidewall. As further illustrated in FIG. 4, the blank comprises a front panel 12, first and second sidewalls 20, 22 and a back panel 37. Also in the embodiment shown, the carton blank comprises a plurality of top flaps 14, 24, 26 and 35, and a bottom flap 16. The blank comprises four crease or fold lines that help to at least partially define the back 37, front 12 and sides 20, 22. The blank further comprises crease or fold lines, which define the top flaps 14, 24, 26, 35 and bottom flap 16.

As further illustrated in FIG. 4, in a preferred embodiment, the front 12 and back panels 37 are substantially rectangular and the sidewalls 20, 22 are irregular pentagons. Preferably the sidewalls 20, 22 have substantially parallel sides, which are defined by the score marks separating the sidewalls 20, 22 from the front 12 and back 37 panels. Still more preferably, the distal end of the sidewalls 20, 22 is triangle-shaped. Still more preferably the bottom portion 53 is an isosceles triangle having an angle $\alpha$ from about 100 to about 160 degrees and more preferably an angle $\alpha$ from about 120 to about 140 degrees.

With further reference to FIG. 4, score marks 40, 42 are disposed substantially horizontally along the sidewalls 20, 22. Preferably the score marks are disposed substantially along the midpoint of the sidewall in its folded configuration. Additional score marks are also disposed along the bottom flap to facilitate deformation of the carton. Preferably at least one score mark is disposed horizontally along the bottom flap and more preferably at least two score marks are disposed horizontally along the bottom flap. In the preferred embodiment illustrated in FIG. 4, a first score mark is disposed between the front panel 12 and the bottom flap 16 and a second score mark 44 is disposed substantially horizontally approximately at the midpoint of bottom flap 16. The score mark 44 causes the bottom flap 16 to preferably assume a substantially v-shape when folded.

Figure 5:
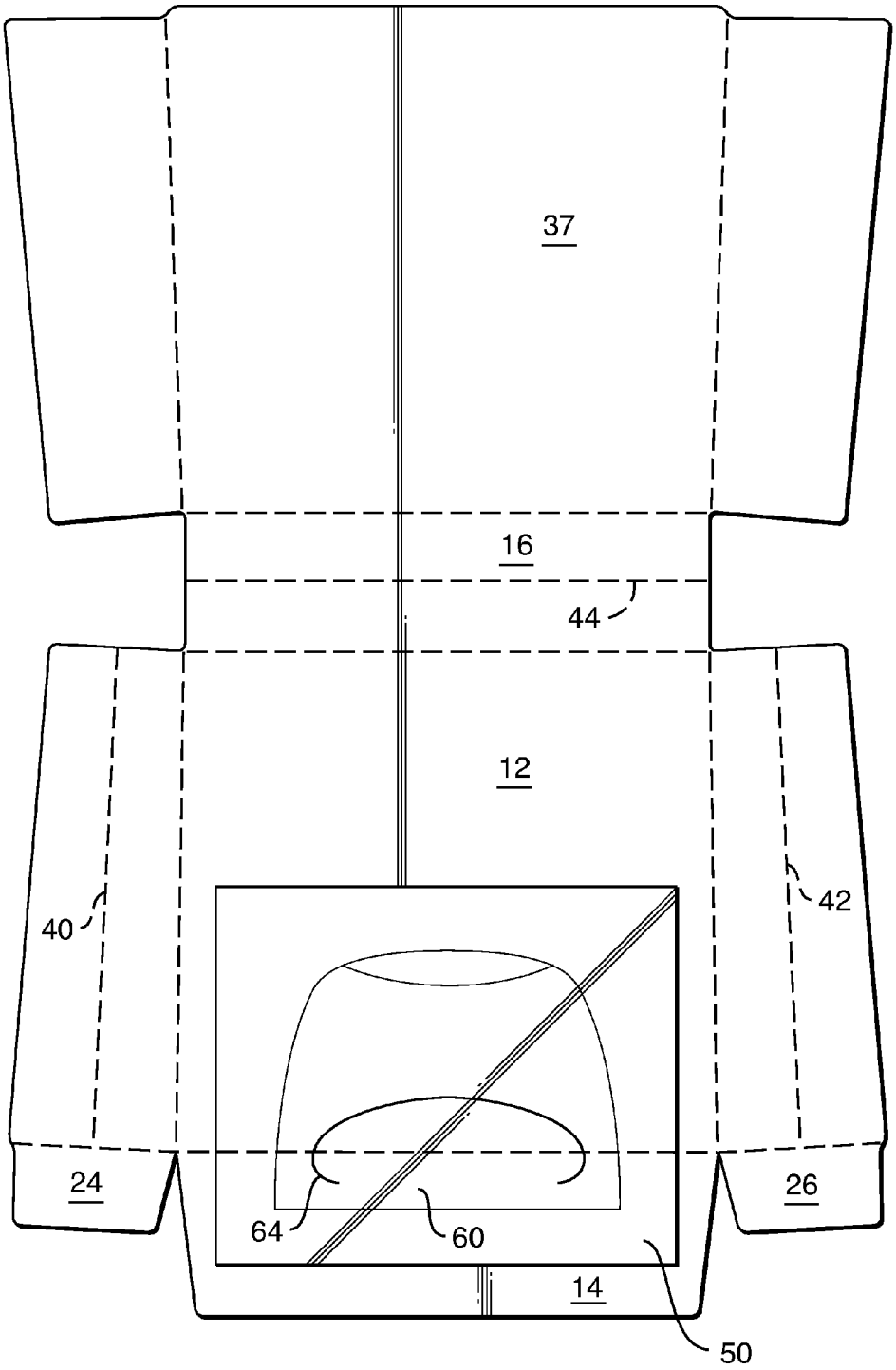
FIG. 5 illustrates a top view of a container blank in accordance with another embodiment of the invention.

Still another embodiment is illustrated in FIG. 5, which is another carton blank that may be folded to form a compressible carton. With reference to FIG. 5, a suitable blank may comprise a back panel 37, a bottom flap 16 and a front panel 12. The blank further comprises a pair of sidewalls 20, 22 attached to the front panel 12 and delineated by a pair of fold marks. A pair of tabs extending from the back flap 37, and delineated by a pair of score marks, are intended to be attached to the sidewalls 20 and 22 when the blank is folded into a carton. The sidewalls 20, 22 further comprise score marks 40 and 42 disposed substantially vertically near the midpoint thereof. The bottom flap 16 also comprises a score mark 44, which is disposed substantially horizontally near the midpoint thereof. The blank further comprises a major top flap 14 and a pair of minor top flaps 24 and 26. When folded the major 14 and minor 24, 26 flaps form the top of the container. In a preferred embodiment the blank has a dispensing opening 60 that is spanned by a pierce of film 50. The film includes a slit 64 for dispensing tissue from the folded carton.

In one embodiment the compressible carton contains a clip of pre-folded, interfolded tissues, wherein the clip of pre-folded, interfolded tissues is oriented within the carton such that the interfolded folds are parallel to the sidewalls of the carton. As used herein, "interfolded" tissues means that the tissues are interleaved. The tissues can be interleaved by any suitable means, including the use of an interfolder as is well known in the papermaking arts. If an interfolder is used, consecutive tissues will be attached to each other at perforation lines. In such cases the unperforated segments of the perforation lines should be sufficiently weak to permit the consecutive tissues to separate from each other upon removal from the carton. This can be controlled by the degree of perforation of the tissue sheet.

The size of the carton is necessarily relatively thin compared to conventional tissue cartons in order to fit into narrow spaces found in automobiles, for example. The maximum depth (thinness) is about 3 inches, preferably about 2 inches or less, and still more preferably about 1.5 inches. The size of the front and back walls are about the size of the pre-folded, interfolded tissue. Interfolding results in the pre-folded tissue being folded in half. Accordingly, it has been found that the front and rear carton walls can be about 5 inches square (5 inches×5 inches) to accommodate typical full-sized facial tissue sheets which have been prefolded (c-folded or v-folded) and thereafter interfolded in half.

In still other embodiments materials may be added to the exterior of the carton to prevent the carton from moving while stored in a compressed state. For example, an adhesive material may be added to the front and back panels of the carton to secure the carton in place, such as between a car seat and console, preventing the carton from being dislodged when the user dispenses a tissue there from. Other friction enhancing materials are contemplated, for example, rubber and rubber-like materials such as latex, and Velcro. The materials may be applied to any surface of the carton to achieve the desired results.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

What we claim is:

1. A compressible carton comprising:

a. a front and a back panel;

b. a pair of opposing sidewalls, each sidewall having a score mark disposed substantially vertically dividing each sidewall into substantially first and second halves, wherein the score marks permit a user to compress the carton;

c. at least one top flap folded to form a carton top;

d. a bottom flap extending from the front or the back panel and folded to form a carton bottom, the bottom flap having a score mark disposed substantially horizontally dividing the bottom flap into substantially first and second halves, wherein the score mark permits a user to compress the carton;

e. a carton opening disposed on the front panel;

f. a dispensing window covering at least a portion of the carton opening; and g. a removable surfboard covering at least a portion of the dispensing window.

2. The carton of claim 1 wherein the carton top is formed from a plurality of top flaps comprising two oppositely disposed minor top flaps extending from the sidewalls, and a major top flap extending from the front or the back panel.

3. The carton of claim 2 wherein the minor top flaps further comprise score marks disposed substantially vertically approximately along their midpoints and substantially in continuity with the vertical score mark disposed along the sidewalls.

4. The carton of claim 2 wherein the major top flap extends from the front panel.

5. The carton of claim 2 wherein the opening is only disposed on the front panel and the major top flap.

6. The carton of claim 1 wherein the sidewalls are irregular pentagons.

7. The carton of claim 6 wherein the sidewalls each comprise a pair of substantially parallel first and second sides and a triangular-shaped bottom portion.

8. The carton of claim 7 wherein the triangular-shaped bottom portion is an isosceles triangle having an angle $\alpha$ from about 100 to about 150 degrees.

9. The carton of claim 1 further comprising a plurality of facial tissues.

10. The compressible carton of claim 1 further comprising a plurality of interfolded tissues.

11. The compressible carton of claim 1 further comprising a friction enhancing material disposed on the front or the back panel.

12. The compressible carton of claim 1 further comprising a film wrapper spanning the front panel.

13. A blank for forming a compressible carton comprising:

a. a first rectangular face, a second rectangular face and a third rectangular face;

b. a pair of sidewalls separated from each other by the rectangular faces, each sidewall having a score mark disposed substantially vertically dividing each sidewall into substantially first and second halves;

c. a plurality of top flaps comprising two minor top flaps extending from the sidewalls, and a major top flap extending from at least one of the rectangular faces;

d. a bottom flap extending from at least one of the rectangular faces, the bottom flap having at least one substantially horizontal score mark dividing the bottom flap into substantially first and second halves; and e. a carton opening disposed on the first, the second or the third face;

f. a dispensing window covering at least a portion of the carton opening and g. a removable surfboard covering at least a portion of the dispensing window.

14. The carton blank of claim 13 wherein the first and third rectangular faces are joined when folded to form the carton.

15. The carton blank of claim 13 wherein the major top flap is folded over the minor flaps to form the container top.

16. The carton blank of claim 13 wherein the sidewalls are irregular pentagons.

17. The carton blank of claim 16 wherein the sidewalls comprise a pair of substantially parallel first and second sides and a triangular-shaped bottom portion.

18. The carton blank of claim 17 wherein the triangular-shaped bottom portion is an isosceles triangle having an angle $\alpha$ from about 100 to about 150 degrees.

19. The carton blank of claim 17 wherein the apex of the triangular-shaped bottom is bisected by the score marked disposed substantially vertically along the sidewall.

20. A compressible carton comprising:

a. a rectangular front wall;

b. a rectangular rear wall;

c. a pair of triangular- or trapezoid-shaped sidewalls connecting the front and rear walls, the sidewalls each having a score mark disposed substantially longitudinally dividing each sidewall into substantially first and second halves, wherein the score marks permit a user to compress the carton;

d. a bottom wall connected to the front or rear wall, the bottom wall having a score mark disposed substantially horizontally dividing the bottom wall into substantially first and second halves, wherein the score marks permit a user to compress the carton; and e. a carton opening disposed on the front wall;

f. a dispensing window covering at least a portion of the carton opening; and g. a removable surfboard covering at least a portion of the dispensing window.

* * * * *